United States Patent [19]

Resk

[11] Patent Number: 4,951,941

[45] Date of Patent: Aug. 28, 1990

[54] PORTABLE MUSCLE TONER

[76] Inventor: William Resk, 140 Douglas Pl., Fleetwood, N.Y. 10852

[21] Appl. No.: 351,667

[22] Filed: May 15, 1989

[51] Int. Cl.[5] ..... A63B 21/00

[52] U.S. Cl. ..... 272/130; 272/143; 272/DIG. 1; 272/DIG. 4

[58] Field of Search ..... 272/67, 68, 120–123, 272/130, 135–143, DIG. 1, DIG. 4

[56] References Cited

U.S. PATENT DOCUMENTS

| | | | |
|---|---|---|---|
| 767,008 | 8/1904 | Pelletier et al. | 272/130 |
| 3,174,343 | 3/1965 | Kasulis | 272/130 X |
| 3,944,221 | 3/1976 | Berkestad et al. | 272/130 |
| 4,148,479 | 4/1979 | Spector | 272/143 |
| 4,333,645 | 6/1982 | Wu | 272/130 |
| 4,832,335 | 5/1989 | Tong | 272/130 |

*Primary Examiner*—Robert Bahr

*Assistant Examiner*—Joe H. Cheng

*Attorney, Agent, or Firm*—Notaro & Michalos

[57] ABSTRACT

A muscle toner comprises a cylinder assembly having a closed end with a handle connected thereto. A piston assembly carrying a second handle is slidably mounted in the opposite end of the cylinder assembly. Seals are provided for sealing the interior space of the cylinder assembly. The piston assembly has a piston rod with an active surface area on which an elevated static operating pressure established in the cylinder assembly acts. This pressure tends to push the piston assembly outwardly of the cylinder assembly. The handles can be pushed together against this static pressure to conduct an exercise routine. A normally closed valve pin operated inflating valve is connected in the piston assembly and can be used in conjunction with a valve pin and bicycle pump to inflate the cylinder assembly to a selected static operating pressure.

10 Claims, 1 Drawing Sheet

PORTABLE MUSCLE TONER

BACKGROUND OF THE INVENTION

The present invention relates in general to exercise equipment, and in particular to a new and useful portable exercise device which comprises a piston assembly which is slidably mounted in a pressurized cylinder assembly. Handles connected to the respective assemblies can be used to press the assemblies together against the resistance of air pressure in the apparatus.

Several portable exercising devices are known which comprise opposite handles which can be grasped and either pressed together or pulled apart for exercising the arms and other parts of the body.

U.S. Pat. No. 767,008 of 1904, discloses an exercise device which comprises a cylinder connected to one handle and a piston which is slidably mounted in the cylinder, connected to another handle. Valves are provided in the cylinder on opposite sides of the piston for metering a flow of air into and out of the cylinder. By regulating the resistance to air flow through the valves, the force needed to move the handles apart and together is adjusted. A similar arrangement is disclosed in U.S. Pat. No. 4,290,599. A portable exercise device which contains oil rather than air as the flowing fluid is disclosed in U.S. Pat. No. 4,148,479.

U.S. Pat. No. 4,333,645 discloses another example where the throttled flow of air is used in a piston and cylinder combination, to produce an exercise apparatus.

U.S. Pat. No. 3,944,221 discloses an exercise apparatus which includes a cylinder connected to one handle and a piston connected to an opposite handle the piston being slidably mounted within the cylinder. Check valves are utilized to admit air into the cylinder as the piston is moved back and forth. The pressure in the cylinder thus increases with each stroke to increase the resistance of the handles to movement. Push button releases are provided to discharge the built up air pressure so that a new exercise cycle can begin.

None of the references disclose the use of a normally closed inflating valve in an exercise apparatus comprising a piston and cylinder combination, sc that the static pressure within the apparatus can be increased to a selected level for conducting exercises at that level.

SUMMARY OF THE INVENTION

The present invention comprises a portable muscle toner which includes a cylinder assembly having a closed end, an open end and an interior chamber, a piston assembly slidably mounted in the open end and into the chamber of the cylinder assembly, sealing means operatively engaged between the piston and cylinder assemblies for sealing the chamber, a normally closed inflating valve communicating with the chamber for inflating the chamber to a selected static operating pressure, and handle means connected to the piston and cylinder assemblies for moving the piston assembly into the cylinder assembly against the resistance of the operating pressure acting on the piston assembly.

The handle means advantageously include a first handle fixed to the closed end of the cylinder assembly and a second handle fixed to an end of the piston assembly which extends out of the cylinder assembly. The inflating valve is advantageously of the type found in footballs, basket balls and the like, which is adapted to receive a valve pin which can be connected to a hand pump for introducing air under pressure into the cylinder assembly. The piston assembly carries a piston head which is slidably mounted within the cylinder assembly. The piston head has opposite active surfaces which face opposite ends of the cylinder assembly. The surface facing the closed end of the cylinder assembly is larger than the surface facing the opposite end of the cylinder assembly by an amount equal to the cross-sectional area of a piston rod of the piston which is connected to the piston head. The piston head experiences a pressure which tends to move the piston assembly outwardly from the cylinder assembly which is caused by the pressure in the cylinder acting on the area of the piston rod. An end cap and bushing is used to both maintain the air pressure within the assembly, and retain the piston assembly from being ejected entirely out of the cylinder assembly.

When exercising, a person holds the handles in his or her two hands, for example, and tries to push the handles together. This movement is resisted by the air pressure being applied to the area of the piston rod by the elevated air pressure within the cylinder assembly.

By inflating or bleeding off the air through the valve pin engaged in the inflating valve, a precise amount of resistance can be achieved. To measure the amount of pressure needed to move the handles together, a simple technique is to press one handle against a bathroom scale a push down on the scale using the opposite handle. When the piston assembly is moved to approximately half its stroke, a reading can be taken from the bathroom scale which represents a mean pressure which is needed to push the handles together.

In order to maintain the elevated static pressure within the cylinder assembly, a floating U-cup seal is engaged around the piston assembly and against the interior wall of the cylinder assembly. This seal is placed between the bushing and the piston head to prevent loss of pressure through the bushing and end cap.

The opposite end of the cylinder assembly may be closed by a second end cap which is permanently and hermetically sealed to the cylinder assembly to preclude any loss of pressure through that end of the cylinder assembly.

In addition to grasping the handles in the hands for conducting an exercise, one handle can be held against the floor and the opposite handle pushed down with both hands to exercise the stomach muscles.

Even when the handles are held by the hands of a person conducting an exercise, the muscle toner can be held in front of the person for exercising the chest muscles, behind the head of the person for exercising shoulder muscles, behind the lower back for exercising back muscles, or with one hand held high and the other held low to exercise the biceps and other arm muscles.

The invention has the significant attribute of being extremely simple in design and construction and being simple to adjust using widely available and inexpensive valve pins and bicycle type hand pumps.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION

Figure 1:
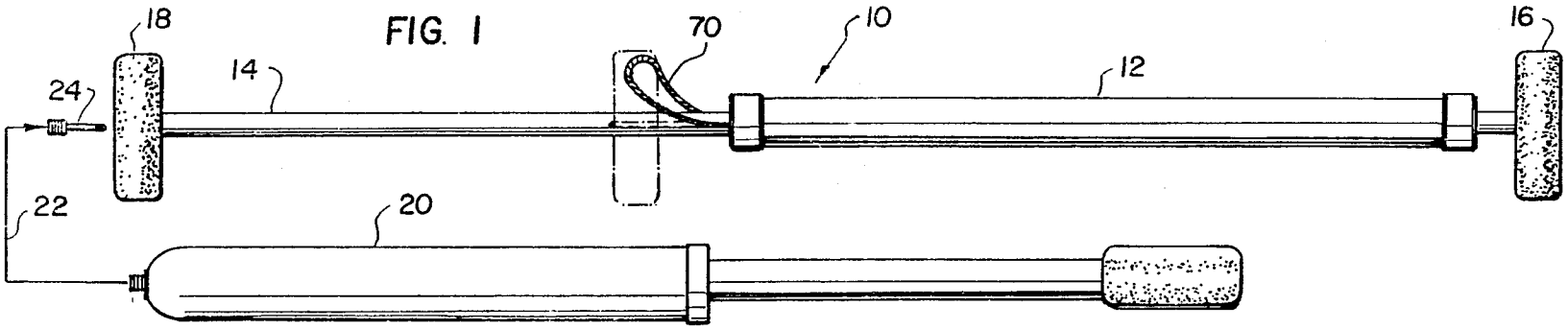
FIG. 1 is a side elevational view showing the muscle toner of the present invention with a bicycle type hand pump used for adjusting the resistance pressure in the toner.
Figure 2:
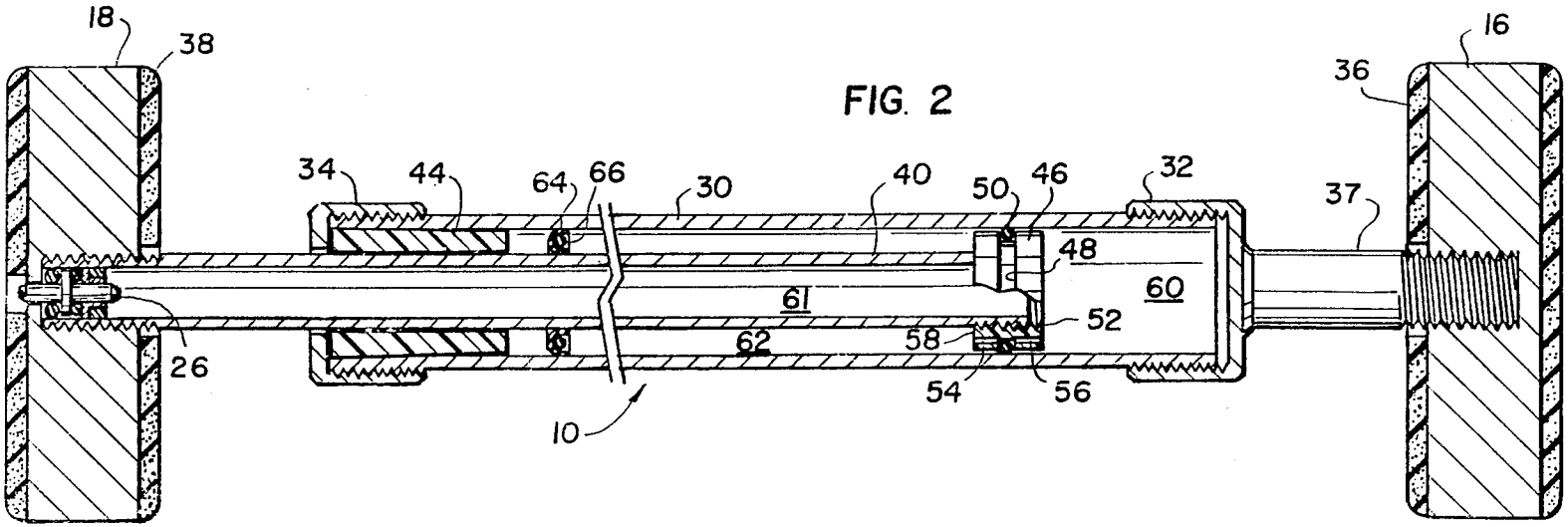
FIG. 2 is a fragmentary longitudinal sectional view of the toner shown in FIG. 1.

Referring the the drawings in particular, the invention embodied in FIG. 1 and 2 comprises a portable muscle toner generally designated 10 having a cylinder assembly 12 which slidably receives a piston assembly 14. A first handle 16 is fixed through a post 37 to a first threaded cap 32 which is screwed and hermetically sealed to the threaded end of a cylinder tube 30.

A second handle 18 is threaded and fixed to the end of a piston tube 40. Handles 16 and 18 may be made of solid plastic, aluminum or other strong material. Each handle is covered by a sponge rubber sheath 36 and 38 respectively for comfort during an exercise.

A normally closed inflating valve 26 which is of conventional design is positioned and sealed in the open end of hollow piston tube 40 which extends out of the cylinder assembly. Valve 26 is of the type normally found in inflatable basket balls, footballs or the like. Valve 26 can be opened and inflated using a valve pin 24 which is also of conventional design. Pin 24 is inexpensive and readily available. Valve 26 is thus refered to as a pin operated inflating valve.

The opposite end of tube 40 is open and communicates with a main chamber 60 defined in cylinder tube 30. Main chamber 60 is separated from an annular chamber 62 positioned around piston tube 40, by a piston head 46 which has an annular groove 48 therearound which receives a O-ring 50 therein. Equalizing holes 54 and 56 extend through the piston head 46 and communicate with groove 48 on opposite sides of O-ring 50. This tends to equalize the pressure between chambers 60 and 62, as well as the pressure on the inside 61 of hollow piston tube 40. The friction of O-ring 50 in the cylinder helps dampen the motion of the piston to avoid its moving too fast.

Piston head 46 has a large area surface 52 facing main chamber 60 and a small annular surface 58 facing the annular chamber 62. The difference in these areas equals the area of tube 40. Any elevated pressure within the piston and cylinder assembly chambers 60, 61 and 62, will cause a net outward pressure against the piston assembly tending to separate the handles 16 and 18. This pressure acts on the area of tube 40.

This pressure can be increased and adjusted using a conventional bicycle type pump 20 which can be connected by a schematically shown hose 22, to the valve pin 24. Pin 24 can be seated in valve 26 for inflating the interior chamber to a selected static pressure. If the static pressure is too high, some air can be bled off using the same valve pin 24.

The piston assembly 14 is retained within the cylinder assembly 12 by a bushing 44 which is advantageously made of hard plastic or other slightly resilient material. The outer surface of bushing 44 is slightly conical and flares to the left as shown in FIG. 2. Bushing 44 is seated in the open end of cylinder tube 30 by a second end cap 34 which is threaded to the end of the cylinder tube. End cap 34 firmly seats the bushing 34 into the end of the cylinder tube and closely engages around the piston tube 40. Enough clearance is left, however, to permit smooth sliding of the piston tube 40 within the bushing 44. To avoid loss of the static pressure in chamber 60, 61, 62 a U-cup seal 64 is closely engaged around the outer surface of piston tube 40 and inner surface of cylinder tube 30. An O-ring 66 is seated within the cup of the cup seal 64. The cup seal has its flanges facing annular chamber 62 so that, when annular chamber 62 is under pressure, the cup seal is expanded and urged to the left to further seal the interior chamber against the outside.

To store piston 14 in cylinder 12, a 1/16" diameter nylon restraint strap 70 is used as shown in phantom line in FIG. 1. The opposite ends of strap 70 are knotted and held in holes in the top of cap 34 on opposite sides of tube 40, to form a loop to engage over handle 18. The loop in its free condition, is in solid line in FIG. 1.

Actual examples of the invention which have been constructed as disclosed here have maintained a static pressure for months.

For strength, tubes 30 and 40, caps 32 and 34 and post 37 are advantageously made of steel, aluminum, or other light, strong metal. The muscle toner of the present invention can be manufactured using relatively simple and inexpensive parts. Despite this, the device is infinitely adjustable by adjusting the static pressure within the chambers. The muscle toner of the present invention is also extremely strong in construction and easy to manipulate and use for a variety of exercise routines.

While a specific embodiment of the invention has been shown and described in detail to illustrate the application of the principles of the invention, it will be understood that the invention may be embodied otherwise without departing from such principles.

The invention claimed is:

1. A portable muscle toner comprising:

a cylinder assembly having a first closed end, a second open end and an interior chamber;

a piston assembly slidably mounted in said open end and into said interior chamber of said cylinder assembly, said piston assembly comprising a piston tube having opposite open ends and being slidably mounted in said open end of said cylinder assembly with part of said piston tube extending into said interior chamber and part of said piston tube extending out of said interior chamber, said interior chamber having an annular chamber (62) around the part of said piston extending into said interior chamber, and a main chamber (60) at said first closed end of said cylinder assembly, said piston assembly further comprising a piston head (46) around the open end of said piston tube which is on the part of said piston tube extending into said interior chamber for sliding along the interior chamber, and for separating said annular chamber from said main chamber, said piston head having an equalizing hole (54,56) therethrough for equalizing pressure between said annular chamber and said main chamber;

sealing means operatively engaged between said piston tube and said cylinder assembly for sealing said interior chamber against the atmosphere;

a normally closed pin operated inflating valve positioned in and closing the open end of said piston tube which is in the part of the piston tube extending out of said interior chamber, said valve communicating with said interior chamber through said piston tube for inflating said interior chamber to a static elevated operating pressure with respect to the atmosphere, said piston assembly being constructed so that the static elevated operating pressure tends to move said piston assembly and said cylinder assembly in opposite directions;

a first handle connected to said closed end of said cylinder assembly; and a second handle connected to said piston tube at the open of the piston tube containing said valve, said first and second handles being movable toward each other for moving said piston assembly and said cylinder assembly together against the static elevated operating pressure.

2. A muscle toner according to claim 1, wherein, said piston tube is hollow and has an interior space communicating with said interior chamber of said cylinder assembly, and an O-ring engaged around said piston head and against an interior wall of said cylinder assembly.

3. A muscle toner according to claim 2 wherein said sealing means includes a bushing fixed to the open end of said cylinder assembly and slidably receiving said piston tube.

4. A muscle toner according to claim 3 wherein said sealing means further includes a U-cup seal slidably engaged between said piston tube and said cylinder assembly for sealing said annular chamber from the atmosphere.

5. A muscle toner according to claim 4 wherein said cylinder assembly further comprises a cylinder tube, a first cap fixed to said cylinder tube to form said closed end of said cylinder assembly and carrying said first handle, and a second cap fixed to said open end of said cylinder tube and retaining said bushing, said piston tube being mounted for moving through said second cap.

6. A muscle toner according to claim 4, further including an annular groove (48) in said piston head (46), said O-ring (50) being in said annular groove, said equalizing hole comprising a first hole (54) in said piston head communicating said annular groove (48) with the annular chamber (62) on one side of said piston head and a second hole (56) in said piston head communicating said annular groove with the main chamber (60) on the opposite side of said piston head.

7. A muscle toner according to claim 1 further including a restraining strap connected to said second open end of said cylinder assembly to form a loop for engagement over said second handle to hold said piston assembly in said cylinder assembly.

8. A portable muscle toner comprising:

a cylinder tube defining an interior chamber and having opposite ends;

a first end cap closing one end of said cylinder tube;

a first handle connected to said first end cap;

a second end cap partly closing the opposite end of said cylinder tube;

a piston tube slidably mounted in said cylinder tube, through the opposite end of said cylinder tube and through said second end cap;

a bushing connected in the opposite end of said cylinder tube and slidably receiving said piston tube, said second end cap holding said bushing in the opposite end of said cylinder tube;

a piston head fixed to an end of said piston tube which is open and which is slidably mounted in said cylinder tube, said piston head being engaged against an interior surface of said cylinder tube, said piston head having a hole means therethrough, the interior chamber of said cylinder tube having an annular chamber around said piston tube on one side of said piston head, and a main chamber on an opposite side of said piston head, pressure between said annular chamber and said main chamber being equalized through said hole means, said piston tube having an opposite end extending out of said cylinder tube;

a second handle connected to the opposite end of said piston tube;

a normally closed pin operated inflating valve fixed in and closing the opposite end of said piston tube adjacent said second handle for inflating the interior of said cylinder tube to an elevated static operating pressure, said piston tube having a cross-sectional area so that said static operating pressure acts on said area and tends to move said piston tube out from said cylinder tube; and an annular seal slidable along and positioned around said piston tube and engaged against an interior wall of said cylinder tube for further sealing said static elevated operating pressure in said cylinder tube.

9. A muscle toner according to claim 8 wherein said hole means includes an annular groove and holes for communicating said annular groove with opposite sides of said piston head, and an O-ring in said annular groove for establishing a sliding seal between said piston head and said interior surface of said cylinder tube.

10. A muscle toner according to claim 8 including a restraining strap connected to said second end cap, to form a loop for engagement over said second handle to hold said piston tube in said cylinder tube.

* * * * *